United States Patent [19]

Sackmann et al.

[11] Patent Number: 4,684,768

[45] Date of Patent: Aug. 4, 1987

[54] RESILIENT SECTIONAL STRIP FOR MOUNTING TO A CLOSURE EDGE

[75] Inventors: Karl H. Sackmann, Waldkirch; Christoph Anselment, Freiburg, both of Fed. Rep. of Germany

[73] Assignee: Erwin Sick GmbH Optik-Electronik, Waldkirch, Fed. Rep. of Germany

[21] Appl. No.: 831,019

[22] Filed: Feb. 19, 1986

[30] Foreign Application Priority Data

Mar. 25, 1985 [DE] Fed. Rep. of Germany ..... 3510806

[51] Int. Cl.[4] ..... H01H 3/16

[52] U.S. Cl. ..... 200/61.43; 200/61.62; 200/61.71

[58] Field of Search ..... 200/61.43, 61.62, 86 R, 200/61.71

[56] References Cited

U.S. PATENT DOCUMENTS 3,118,984 1/1964 Koenig ..... 200/86 R X 4,532,388 7/1985 Sackmann et al. ..... 200/61.62 X

*Primary Examiner*—A. D. Pellinen

*Assistant Examiner*—Morris Ginsburg

*Attorney, Agent, or Firm*—Townsend and Townsend

[57] ABSTRACT

A resilient intermediate section (12) is arranged inside the hollow cavity (11) of a resilient section (14) of essentially triangular cross-section. The intermediate section (12) has a flat base portion (15) which contacts the base surface (13) of the resilient section (14) and a switching strip (18) is arranged on the flat base portion (15). In addition the intermediate section (12) has limbs (16) which extend into the tapering hollow cavity (11) and encloses the sides of the switching strip (18). If the section (14) bends due to contact with an obstacle then the limbs (16) are respectively acted on by further arching of the side surfaces (17) and act in turn via inwardly directed actuating ribs (20) on the surface of the switching strip (18) which faces the apex edge (19) of the resilient section.

10 Claims, 3 Drawing Figures

RESILIENT SECTIONAL STRIP FOR MOUNTING TO A CLOSURE EDGE

Figure 1:
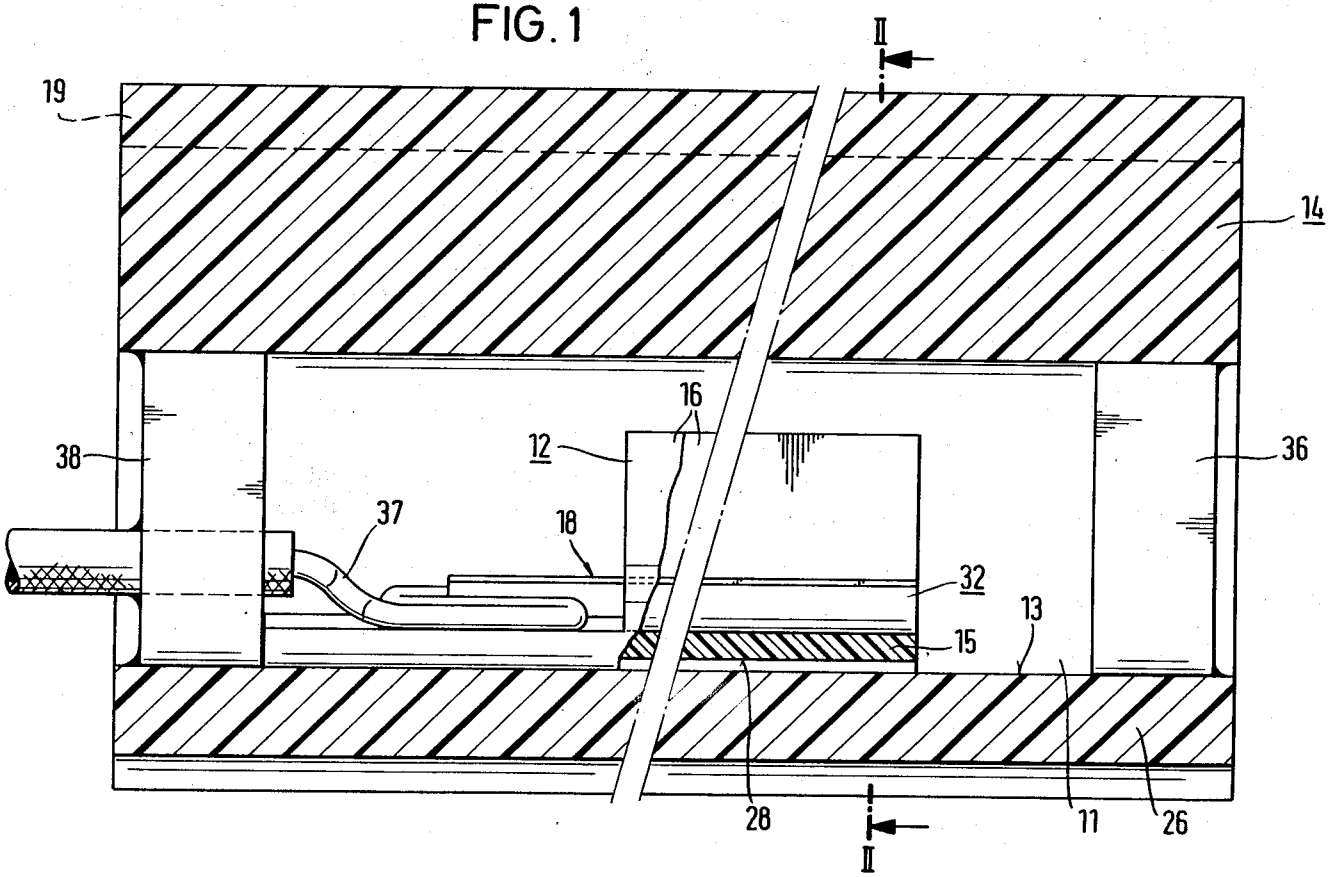

The invention relates to a resilient sectional strip for mounting to the closure edge of a closure movable to close an opening, such as a swing door, a sliding door, a rolling door or a container cover.

In one known arrangement U.S. Pat. No. 4,532,388 the strip comprises a first resilient elongate hollow section (FIG. 5, 119, 126, 127, 136) extending along said closure edge and having a hollow cavity (135); a second resilient intermediate section (112) (disposed within said hollow cavity (135) and having a flat base portion contacting a base surface (119) of said first hollow section; and a resilient electrical switching strip (11) having two metallic contact strips (15,16) or ribbons which are electrically isolated (34) from one another and resiliently spaced apart, said switching strip (11) being arranged on said flat base portion, wherein said intermediate section (112) has limbs which extend from its side edges into the hollow cavity (135) and surround said switching strip.

The known arrangement is contrived so that deformation of the resilient sectional strip leads to contact between the two metallic contact strips within the electrical switching strip which initiates an electrical warning and/or stop signal for the drive for the door. This is described for example in U.S. Pat. No. 4,532,388.

In all known resilient sectional strip arrangements special measures have to be taken in order to ensure that the electrical switching strip is loaded in such a way that contact occurs both for forces which act perpendicular to the closure edge and for side forces which are displaced relative thereto through approximately 90°. For this purpose it is sometimes necessary to provide two switching strips or to use specially shaped web arrangements within the resilient sectional strip.

In a further known electrical contact strip as described in German Patent Application DE-OS No. 28 08 964 the conductors are arranged directly at the inner side of the section which makes the section complicated and expensive to manufacture. Contact only occurs with lateral loads, not however when a force acts centrally on the sectional strip. This sectional strip can thus not be used to make closure edges safe.

In contrast, the object underlying the present invention is to provide a resilient sectional strip of the initially named kind which is of particularly simple construction, while being simple to manufacture, and which nevertheless reliably and rapidly brings about contact at the switching strip for all loads which occur in practice, i.e. both for central forces and also laterally acting forces.

This object is satisfied by an arrangement of the initially named kind which is characterised in that said first hollow section has a substantially triangular cross-section, with the apex of the triangle directed towards the opening to be closed, and has slightly inwardly arched side surfaces and a corresponding hollow cavity of substantially triangular cross-section, with the base of said triangle being disposed at said closure edge; in that said limbs which surround said switching strip are arranged at the inside of the side surfaces of said first hollow section in such a way that on bending of said first hollow section through contact with an obstacle said limbs will be respectively loaded by one of said side surfaces which arches further inwardly; and in that said limbs have at the inside, in the region of the surface of said switching strip which faces said apex, inwardly directed actuating projections, in particular actuating ribs, which in the normal state do not exert any actuating pressure on said switching strip, but act however, due to a respective one of side-arched side surfaces and the associated limb, on said switching strip substantially from above and produce contact between said contact strips.

Thus, in accordance with the invention, the hollow cavity of substantially triangular cross-section which is present in the first resilient elongate hollow section is almost completely exploited to accommodate the intermediate section which in turn contains the electrical switching strip. The changes in curvature of the side surfaces which occur during deformation of the first resilient section are passed on in each case to one of the limbs of the intermediate section which is then so deformed that the associated actuating projection presses on the switching strip essentially from above and deforms it in such a way that contact between the metallic strips reliably occurs. The switching strip responds, irrespective of the direction in which the resilient sectional strip is loaded.

A preferred embodiment is characterised in that the actuating ribs are spaced by a small distance from the switching strip. In this manner it is ensured that contact does not immediately occur for even trivial contact between an obstacle and a hollow section but instead that a certain path must be followed or deformation must occur before the contact strips in the switching strip contact one another.

A further embodiment is characterised in that in the normal state at most the outer ends of the limbs of the intermediate section contact the side surfaces of said first hollow section, with a small spacing preferably being left, in particular of up to approximately 2 mm. The embodiment should in particular be such that the base portion of the intermediate section is laterally spaced from the side surfaces of the first resilient section.

In this manner the outer ends of the limbs center the intermediate section, the base portion of which contacts the base surface of the first hollow section. The introduction of the intermediate section into the hollow cavity is possible with with little force or effort because the limbs which are spaced apart from one another by a substantial distance can easily yield resiliently inwardly and can thus be drawn into the resilient outer section with only a small degree of frictional resistance. In the inserted state the intermediate section nevertheless adopts a defined position within the resilient section while the limbs spring outwardly again and take on the function of securing the position of the intermediate section in the hollow cavity of the resilient outer section. The above described function is not impaired if the intermediate section is displaceable by a small amount from the central position to either side, which is possible when the outer ends of the limbs of the intermediate section have a small spacing of up to 2 mm from the side surfaces.

It is particularly preferred for the limbs to extend at a substantial angle of preferably 30° to 60°, and in particular approximately 40° to 50° from a base portion of said second intermediate section to above the switching strip and for them there to bend away, preferably while defining a crease, into a direction which extends substantially perpendicular to said base portion while forming the actuating ribs.

A further alternative consists in that the limbs have a concavely curved outer surface and indeed preferably similar to the curvature of the side surfaces in the non-deformed state. In this manner the intermediate section simultaneously serves to carry the switching strip which is preferably adhesively connected to the base portion, to form the actuating ribs for the switching strip, and to form the actuating end pieces of the limbs.

An advantageous further development of the invention is characterised in that foils which reduce friction and wear are arranged between the limbs and the switching strip. The foils should in particular be adhesively connected to the limbs.

In order to reinforce the intermediate section a further embodiment is constructed so that axial passages in which reinforcement wires are arranged are provided in the transition region from the base portion to the limbs, and preferably open towards the inside.

Figure 2:
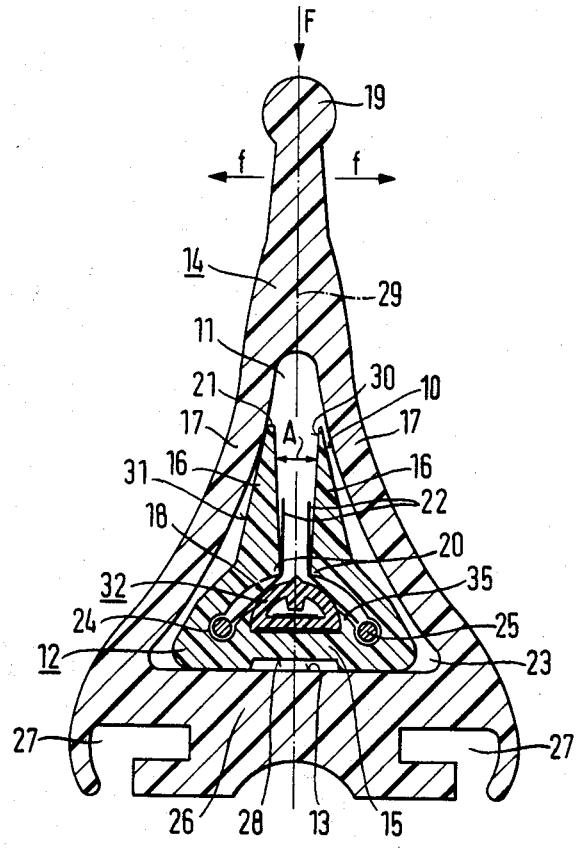
Figure 3:
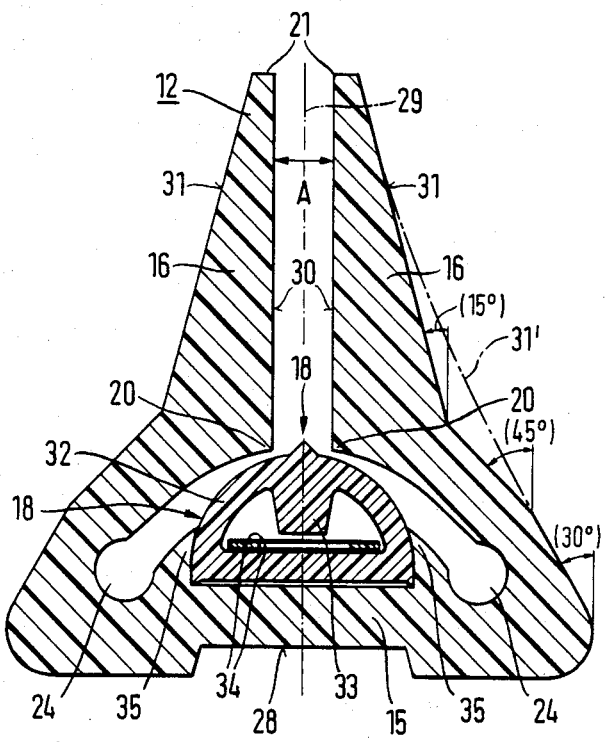

The invention will now be described in further detail by way of example only and with reference to the accompanying drawings which show:

FIG. 1 a partly sectioned side view of a resilient sectional strip in accordance with the invention, FIG. 2 a section on the line II—II of FIG. 1, and FIG. 3 an enlarged cross-section of the intermediate section embodied in the resilient sectional strip of the invention.

As seen in the drawing a resilient section 14 which consists for example of rubber has a substantially triangular cross-section, with the side surfaces 17 of the section 14 however being slightly inwardly arched or curved in accordance with FIG. 2 so that on bending the section in the direction of one of the arrows f in FIG. 2 the respectively associated side surface 17 will be arched more and the oppositely disposed side surface 17 will be stretched somewhat more. As a result of the special triangular shape of the section 14 bending occurs in the direction of one of the arrows f even when the resilient section 14 is loaded in the direction of the arrow F by the opening which is to be closed. The bead-like triangular tip of apex edge 19 which faces the opening which is to be closed is then deflected sideways either in the direction of the one or the other arrow f.

At its end facing away from the bead-like apex 19 of the triangle the resilient section 14 has a base 26 which can be secured in suitable manner, for example by means of the grooves 27, to the closure edge of, for example, a door or a roller door.

The resilient intermediate section 12 has an elongate and essentially flat base portion 15 which lies flatly on the base surface 13 of the hollow cavity 11. At its center region the flat base portion 15 has an elongate recess 28 which has the purpose of making the intermediate section 12 as flexible as possible.

Two limbs 16 extend from the two sides of the base portion 15 in the direction towards the bead-like apex 19 of the resilient section 14 and extend first of all at an angle of 30° and then at an angle of 45° to the central longitudinal plane 29 of the resilient section 14. Thereafter they bend away practically perpendicular to the base portion 15 in the direction of the edge 19. The inner surfaces 30 of the end region of the limbs 16 are precisely perpendicular to the base portion 15 whereas the outer surfaces 31 include an angle of approximately 15° with the central longitudinal plane 29.

In an advantageous alternative embodiment the two outer surfaces of the limbs 16 of the intermediate section 12 can also be concavely curved and of circular curvature as is illustrated by the chain-dotted line 31' in FIG. 3.

An electrical switching strip 18 is arranged on the base portion 15 at the center. The electrical switching strip 18 consists of a resilient curved section 32 with a cavity which has a flat base surface and a semi-cylindrical actuating surface from which a switching rib 33 extends towards the flat base region. A resilient contact band pair 34 is mounted on the flat base region and consists of two spring-like sheet metal ribbons which are held spaced apart by an insulating material. The electrical switching strip 18 is the same as the switching strip described in the U.S. Pat. No. 4,532,388. As a result of the bending away of the limbs 16 in the region directly above the electrical switching strip 18, actuating ribs 20 are created at a small distance from the electrical switching strip 18 and are located a small distance above the electrical switching strip 18.

FIG. 2 shows two embodiments of the limbs 16. In a first embodiment, which is shown on the left-hand side of the plane 29, the ends of the limbs 16 contact the side surface 17 of the resilient section 14 at the inside. In the other embodiment, shown on the right-hand side of the plane 29, the ends of the limbs 16 are arranged with a small distance 10 from the side surfaces 17, the respective distance 10 being not larger than about 2 mm.

As can also be seen from FIG. 2 a polyester foil 22 which is resistant to wear and friction is inserted between the limbs 16 and the electrical switching strip 18, and is preferably adhesively connected to the limbs 16. The foil serves for chemical separation between the resilient curved section 32 which consists of PVC (polyvinyl chloride) and the intermediate section 12 which consists of rubber.

Elongate axially directed passages 24 are provided internally in the intermediate profile 12 in the transition region between the base portion 15 and the limbs 16 and the walls of the passages extend over approximately three quarters of a circle. As can be seen in FIG. 2 axial reinforcement wire 25 can be arranged in the passages 24. Clamping tongues 35 extend from the base portion 15 around the lower longitudinal region of the switching strip 18 and reliably secure the switching strip 18, which can additionally be adhesively bonded in place.

A substantial spacing A is present between the limbs 16 and is necessary for effortless actuation of the switching strip 18. As seen in FIG. 2 the intermediate section 12 is so shaped that it merely contacts the inner walls of the hollow cavity 11 at the lower surface of the base portion 15 and at the ends 21 of the limbs 16.

The assembly and manner of operation of the resilient section of the invention are as follows:

After the electrical switching strip 18 has been adhesively bonded in the intermediate section 12 and after the foils 22 have been set in place the intermediate profile 12 containing the electrical switching strip 18 is drawn axially into the hollow cavity 11 of the resilient section 14 which is possible without effort because the limbs 16 can yield resiliently inwardly during insertion with the distance A becoming smaller. At one end the hollow cavity 11 is then closed by a plug 36 whereas the electrical contact 37 is inserted at the other end. Electrical contact between contact 37 and the strip pair 34 is provided by two wires, one to each of the strips in strip pair 34. A closure member 38 is likewise provided in this region.

Finally, the resilient section 14 is secured to the closure edge of a door or the like.

If now forces act on the resilient section 14 in the direction of the arrows f or F as a result of contact of the bead-like edge 19 with an obstacle, then the edge 19 deflects in any event in the direction of one of the arrows f, i.e. laterally, whereupon the associated side surface 17 of the the resilient section 14 adopts a more pronounced curvature and hereby presses the associated limb 16 inwardly while making the distance A smaller. During this the actuating ribs 20 pivot essentially about the connection point with the base portion 15 and press in FIGS. 2 and 3 substantially from above onto the switching strip 18 whereupon the actuating rib 33 loads the contact strip pair 34 and gives rise to electrical contact. Thus a switching signal is initiated in a simple and reliable manner.

Thus an intermediate section 12 is present for the switching strip 18. The intermediate section 12 is inserted into the resilient section 14 and transmits a light and reliable switching movement to the switching strip 18 as a result of the delta-like cross-section. As the delta-like outer contour of the resilient elongate section 14 has to deflect each time it is loaded, the lateral arching of the resilient elongate section 14 will always be transmitted to the intermediate section 12. The transmission of the forces from the intermediate section 12 to the switching strip 18 take place via a lever arm. In this way a switching process is generated with very little force. The intermediate section 12 is so arranged that the extended limbs 16 accommodate the deflection of the section 14 and thus substantially act on the switching strip 18 from above.

We claim:

1. A resilient sectional strip for mounting to a closure edge of a closure movable to close an opening, such as a swing door, a sliding door, a roller door or a container cover, the strip comprising a first resilient elongate section extending along a closure edge and having a hollow cavity; a second resilent intermediate section disposed within said hollow cavity and having a flat base portion contacitng a base surface of said first resilient elongate section; a resilient electrical switching strip having first and second metallic contact strips which are electrically isolated from one another and resiliently spaced apart, said switching strip being arranged on said flat base portion, said intermediate section having limbs which extend from its side edges into the hollow cavity and enclose the sides of said switching strip, said first resilient elongate section having a substantially triangular cross-section, with the apex of the triangle directed towards an opening to be closed, slightly inwardly arched side surfaces and a corresponding hollow cavity of substantially triangular cross-section, with the base of the triangle being disposed at the closure edge; said limbs which enclosing sides of said switching strip being arranged at the inside of arched side surfaces of said first resilient elongate section in such a way that on bending of said first resilient elongate section through contact with an obstacle said limbs will be respectively loaded by one of said side surfaces which arches further inwardly; said limbs including at their insides, in the region of the surface of said switching strip which faces said apex, inwardly directed actuating ribs arranged so that in the normal state they do not exert an actuating pressure on said switching and so that an actuating pressure is exerted on said switching strip when one of said arched side surfaces and the associated limb is deflected.

2. The resilient sectional strip of claim 1, wherein the actuating ribs are spaced by a small distance from the switching strip.

3. The resilient sectional strip of claim 1, wherein in the normal state at most the outer ends of the limbs of the intermediate section contact the side surfaces of said first resilient elongate section.

4. The resilient sectional strip of claim 1, wherein the limbs extend in the region of the switching strip at a substantial angle of 30 to 60 degrees from a base portion of said second intermediate section to above the switching strip and there bend away, with a crease, into a direction extending substantially perpendicular to said base portion while forming the actuating ribs.

5. The resilient sectional strip of claim 1, wherein the libs have a concavely curved outer surface similar to the curvature of the side surfacss in the non-deformed state.

6. The resilient sectional strip of claim 1, wherein foils are arranged between the limbs and the switching strip and serve to chemically separate a resilient curved section with a cavity, which resilent curved section is fabricated from a synthetic material, from said intermediate section which intermediate section may be fabricated from rubber, and said foils being also constructed to reduce friction and wear.

7. The resilient sectional strip of claim 6, wherein the foils are adhesively connected to the limbs.

8. The resilient sectional strip of claim 1, wherein the base of the triangular cross-section of said first resilient elongated section extends laterally beyond the base portion of said resilient intermediate section and from the limbs.

9. The resilient sectional strip of claim 1, wherein passages in which reinforcement wires are disposed are provided in the transition region from the base portion of said resilient intermediate section to said limbs and open towards the inside.

10. The resilient sectional strip of claim 1 wherein in the normal state the outer ends of the limbs of the intermediate section are spaced a small distance from the arched side surfaces of the first resilient elongate section.

* * * * *